US005235841A

United States Patent [19]

Harris

[11] Patent Number: 5,235,841

[45] Date of Patent: Aug. 17, 1993

[54] CRIMPING APPARATUS

[75] Inventor: Jack L. Harris, Lakewood, Colo.

[73] Assignee: The Gates Rubber Company, Denver, Colo.

[21] Appl. No.: 447,305

[22] Filed: Dec. 7, 1989

Related U.S. Application Data

[62] Division of Ser. No. 145,445, Jan. 19, 1988, Pat. No. 4,885,928.

[51] Int. Cl.[5] ..... B21D 41/04; B23P 11/00

[52] U.S. Cl. ..... 72/402

[58] Field of Search ..... 72/402, 399, 452, 416; 29/237, 243.52, 508

[56] References Cited

U.S. PATENT DOCUMENTS

| | | | |
|---|---|---|---|
| 3,096,876 | 7/1963 | Scudieri | 29/237 |
| 3,768,298 | 10/1973 | Olive-Jones | 72/402 |
| 3,805,580 | 4/1974 | Leiker | 29/237 |
| 4,285,228 | 8/1981 | Gunning | 72/402 |
| 4,357,822 | 11/1982 | Patel | 72/402 |

*Primary Examiner*—Daniel C. Crane

*Attorney, Agent, or Firm*—H. W. Oberg; C. H. Castleman, Jr.; J. L. Isaac

[57] ABSTRACT

Crimping apparatus includes a pair of coaxial rings, at least one of which is axially moveable toward and away from the other ring. Each ring is provided with a single pair of force reactive adjoining steep and shallow concave frustoconical surfaces which face each other. A plurality of circumjacent, radially arranged crimping members are positioned intermediate the rings. Each crimping member has two pairs of steep and shallow force reactive convex frustoconical surfaces that slidably engage with the concave force reactive surfaces of the rings to radially move the crimping members to and from the ring axis between an open position and a crimping position. The radial movement of the crimping members is in response to axial movement of at least one of the rings. The crimping apparatus further includes apparatus for reducing the speed of an axially moveable depth stop so that the axial position of a member to be crimped can be maintained relative to that of the crimping members during the crimping stroke of the apparatus. Also disclosed is a housing and ram pusher that have cutouts for accomodating bent tube fittings.

3 Claims, 6 Drawing Sheets

CRIMPING APPARATUS

This is a division of application Ser. No. 07/145,445 filed Jan. 19, 1988, now U.S. Pat. No. 4,885,928.

TECHNICAL FIELD

The invention relates generally to crimping methods and apparatus and, more particularly, to method and apparatus for crimping using a plurality of radially positioned and moveable members.

BACKGROUND ART

A major problem associated with double cone or ring crimping machines is the lack of sufficient clearance for loading large diameter fittings and bent fittings, particularly the latter. This problem is illustrated in FIGS. 1 and 2 wherein it can be seen that as die cones 1 retract to open dies 2, the inside edge 2 of the die cones projects radially inward into the opening through which a fitting is inserted to be crimped, thereby partially obstructing the opening. The restricted opening not only makes it difficult to insert larger diameter fittings, but also makes it particularly difficult, if not impossible, to insert many bent fittings. PCT Patent Application Serial Number PCT/EP/00024, filed on Feb. 1, 1983, to Sauder discloses a double cone crimping machine of this general type.

FIGS. 3 through 5 illustrate the crimping head components of another double cone crimping machine in use today which utilizes a pair of two-step cones 5 and a plurality of radially arranged two step dies 7. This crimper is finding acceptance because it requires less cylinder stroke than the crimper illustrated in FIGS. 1 and 2. However, it can be appreciated, from FIGS. 3–5, that each two-step cone is quite wide. This is because part of each cone (i.e., that part identified by dimension X) extends beyond edges 9 of die 5 when the components are in their open loading position. The extension of the cones beyond the die's edges is undesirable because it increases the overall length of the crimping assembly or head, thereby increasing the distance a fitting must be inserted between the dies. This not only makes it more difficult to insert a bent fitting through the dies, but also decreases the size of bent fittings which can be inserted into and through the dies.

A two step, double cone crimping machine which is similar to that illustrated in FIGS. 3 through 5 is Saudr Press Model No. Type 88 made by Saudr Press AG of Zurich, Switzerland. The axial length or distance a fitting can be inserted through this crimper is 8.25 inches and the radial distance travelled by one of the crimping die members during a stroke of the crimper is 0.645 inches. This provides the Saudr Type 88 crimper with a relatively high axial crimper length to radial die movement ratio of 12.8:1. As such, many of the larger bent fittings cannot be inserted through the crimper, at least not without first removing the die members from the crimper's crimping head which, quite obviously, is a time consuming task.

An object of the present invention is to provide a crimping apparatus having a crimping head which is capable of accommodating most standard bent fittings.

Another object of the present invention is to provide a double angle, double ring crimping apparatus which is capable of maintaining its crimping members in alignment during the apparatus' crimping stroke.

SUMMARY OF THE INVENTION

The present invention provides improved apparatus and methods for crimping members, generally tubular members, together. The crimping apparatus includes a pair of first and second axially spaced, coaxial rings, at least one of which is axially moveable by an actuating means of the crimper toward and away from the other ring. Each ring is provided with a single pair of force reactive adjoining steep and shallow concave frustoconical surfaces and the rings are oriented so that their force reactive surfaces face each other. In addition, the rings' steep surfaces are inclined at a greater angle from the ring axis than the shallow surfaces.

The crimping apparatus also includes a plurality of circumjacently spaced and radially arranged crimping members which are positioned intermediate the rings. Each crimping member has a first and second pair of steep and shallow force reactive convex frustoconical surfaces that slidably engage with the concave force reactive steep and shallow frustoconical surfaces of the first and second rings. As such, the engaging force reactive convex and concave frustoconical surfaces define means for radially moving the crimping members toward and away from the ring axis between an open position and a radially inward crimping position. The radial movement of the crimping members is in response to axial movement of at least one of the annular rings which is moved by the actuating means. The crimping members steep convex surfaces are also inclined at a greater angle from the ring axis than the crimping members shallow convex frustoconical surfaces. The crimping apparatus also includes novel means for maintaining the crimping members in alignment while they are moved between the open and crimping positions.

A crimping method of the present invention includes providing a double angle, double ring crimping apparatus having a plurality of circumjacent, radially arranged crimping members positioned intermediate the rings. The crimping members are axially and radially moveabla along the ring axis of the crimping apparatus between an open loading position and a closed crimping position. The axial and radial movement is in response to axial movement of at least one of the rings. The crimping apparatus also has an axial crimping head length to radial die movement ratio which is less than 12.8:1, preferably between 6:1 and 9:1. The method further includes locating a member to be crimped between the plurality of circumjacent, radially arranged crimping members so that the member is capable of being crimped by the crimping members when the crimping members move radially inward to the crimping position. The method further includes axially moving at least one of the rings towards the other to move the plurality of crimping members radially inward from the open position to the crimping position to crimp the member.

Additional advantages of this invention will become apparent from the description which follows, taken in conjunction with the accompanying drawings.

BEST MODE FOR CARRYING OUT THE INVENTION

Figure 6:
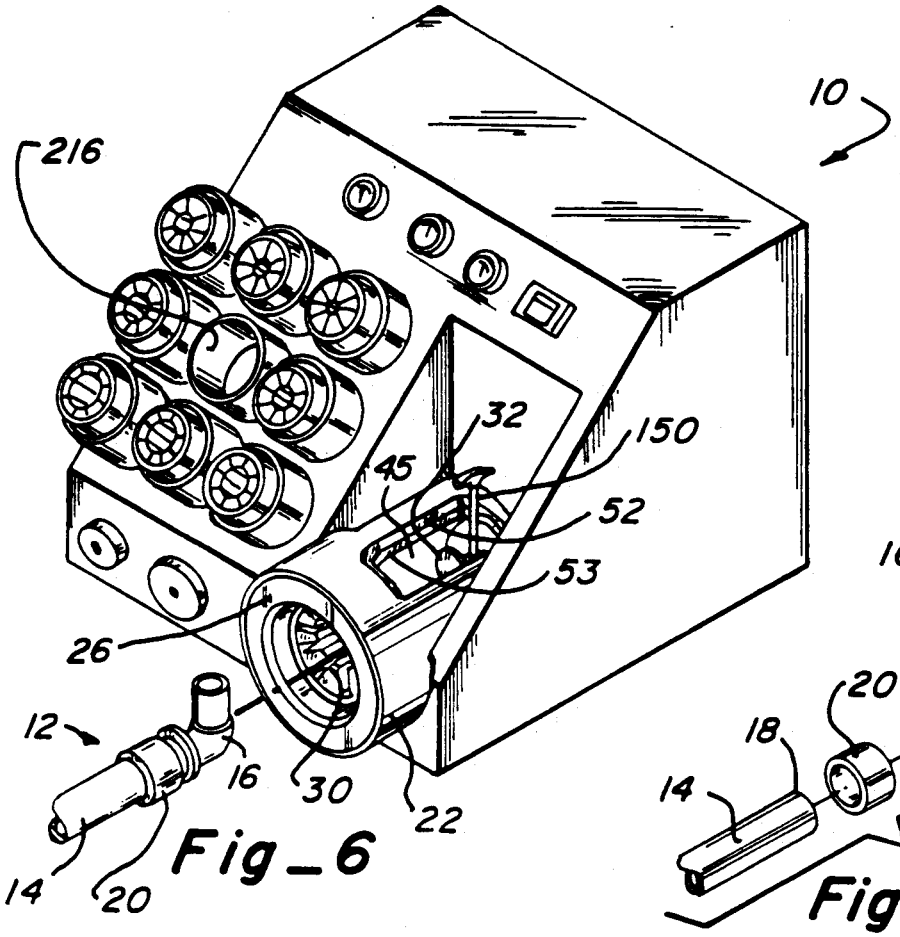
FIG. 6 is a perspective view illustrating a crimping apparatus of the present invention and a bent fitting assembly which is capable of being crimped by the crimping apparatus.
Figure 7:
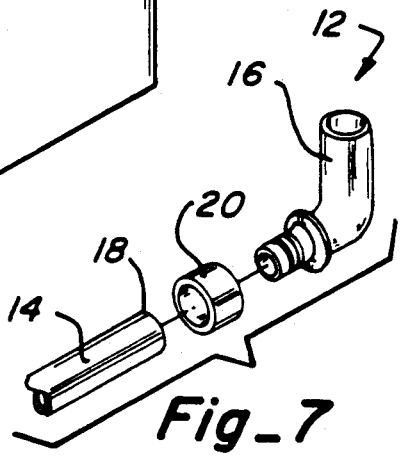
FIG. 7 is an exploded perspective view of the bent fitting assembly illustrated in FIG. 6.
Figure 8:
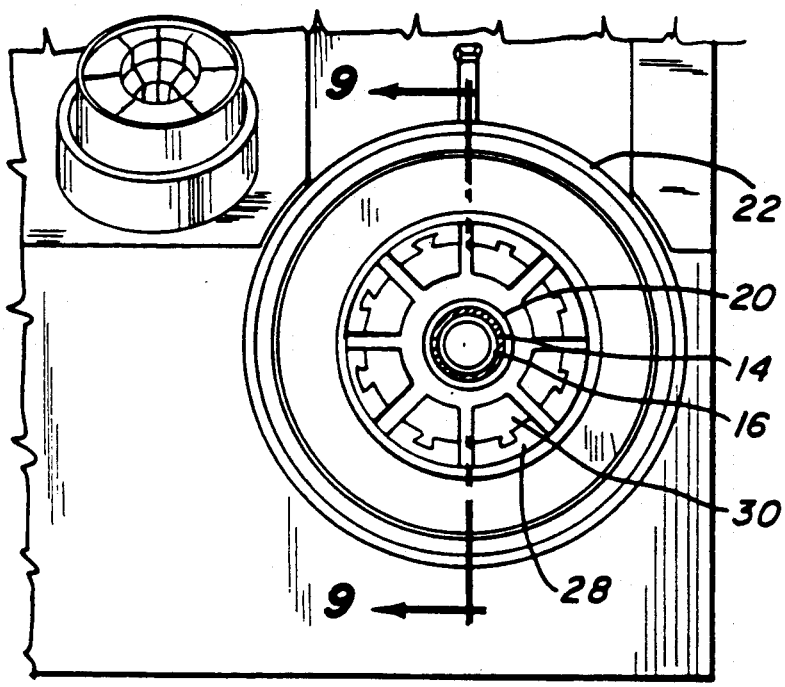
FIG. 8 is a partial broken away front view of the crimping apparatus illustrated in FIG. 6.

FIG. 6 illustrates a crimping device 10 of the present invention for securing or crimping the components of a flexible hose assembly 12 together. FIG. 7 is an exploded view of hose assembly 12 illustrating a flexible hose 14, a bent fitting 16 which is inserted into an end 18 of hose 14 and a ferrule 20 which is inserted over end 18 of hose 14. Ferrule 20 is crimped by device 10 to secure the bent fitting to the hose.

Figure 9:
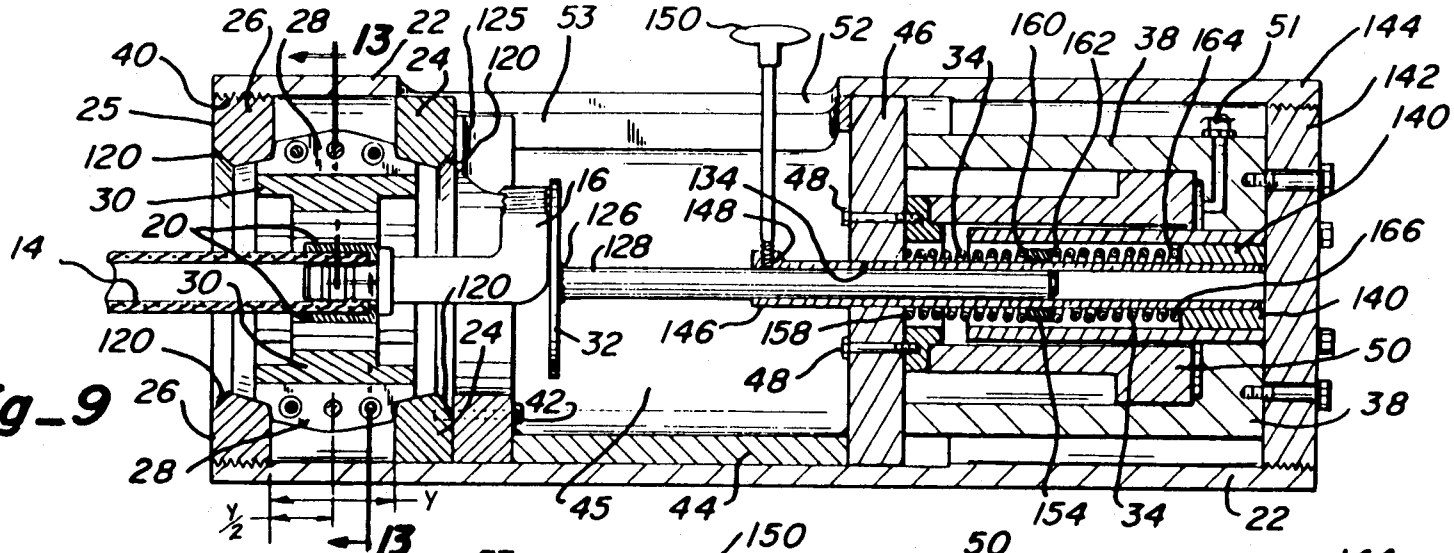
FIG. 9 is a cross-sectional view taken along the lines 9—9 of FIG. 8.
Figure 10:
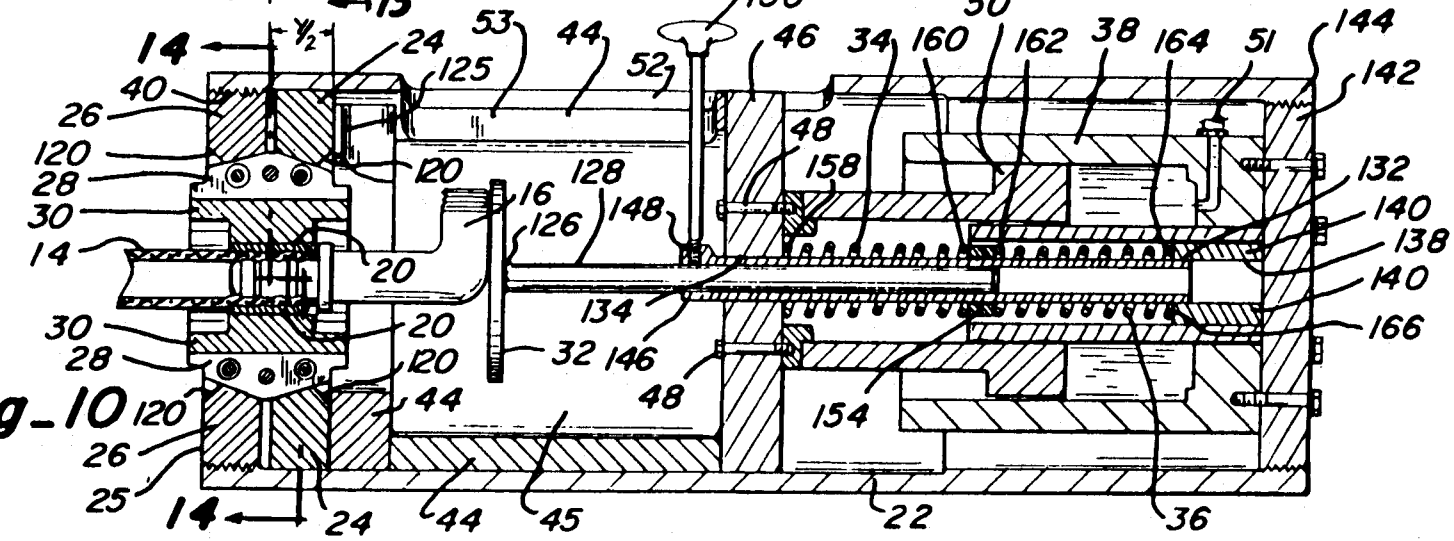
FIG. 10 is a cross-sectional view similar to FIG. 9 illustrating, however, the crimping apparatus in its crimping position.
Figure 11:
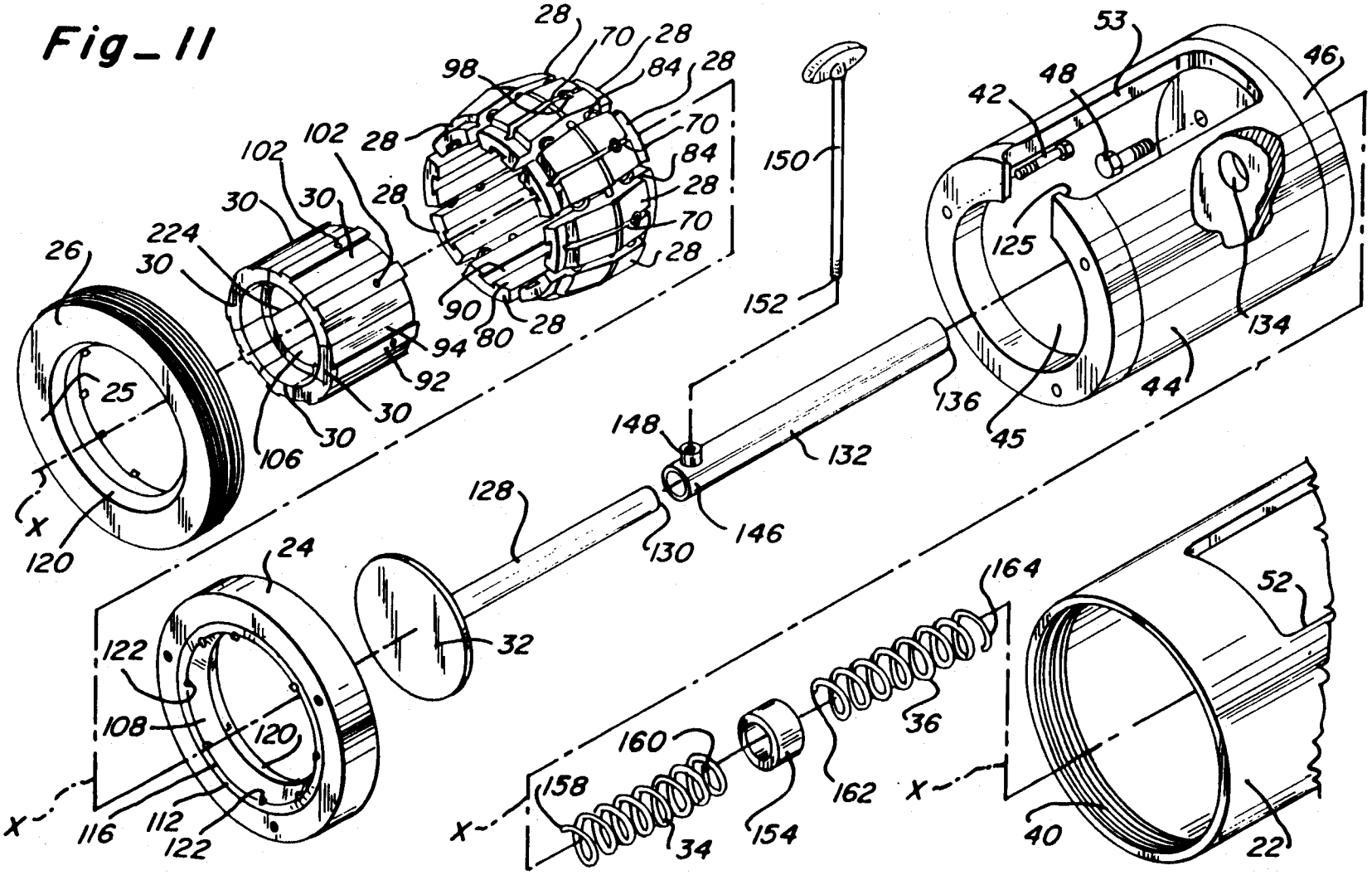
FIG. 11 is an exploded perspective view illustrating the major components of the crimping apparatus of the present invention.

Device 10 generally includes, as best illustrated in FIGS. 9-11, a cylindrical housing or base 22, a movable first or inner die cone or ring 24, a stationary second or outer die cone or ring 26, and eight circumjacently spaced and radially arranged, spring loaded crimping members including die shoes 28 and die fingers 30. Device 10 also generally includes a depth stop 32, first or front spring means 34 and second or back spring means 36, and a hydraulic cylinder actuating means 38.

Outer ring 26 is threadably secured to a threaded end 40 of housing 22 while movable ring 24 is rigidly secured by a bolt means 42 to a cylindrically shaped ram pusher 44. Ram pusher 44 defines a cylindrically shaped chamber 45 which is sized and configured to contain or accommodate most bent fittings. Ram pusher 44 also nag a disc shaped, back plate centering means 46 which is rigidly secured by a bolt means 43 to a piston 50 of actuating means 38. Actuating means 38 is supplied with hydraulic fluid via a supply line 51 to drive piston 50 in a conventional manner which forms no part of this invention.

Figure 12:
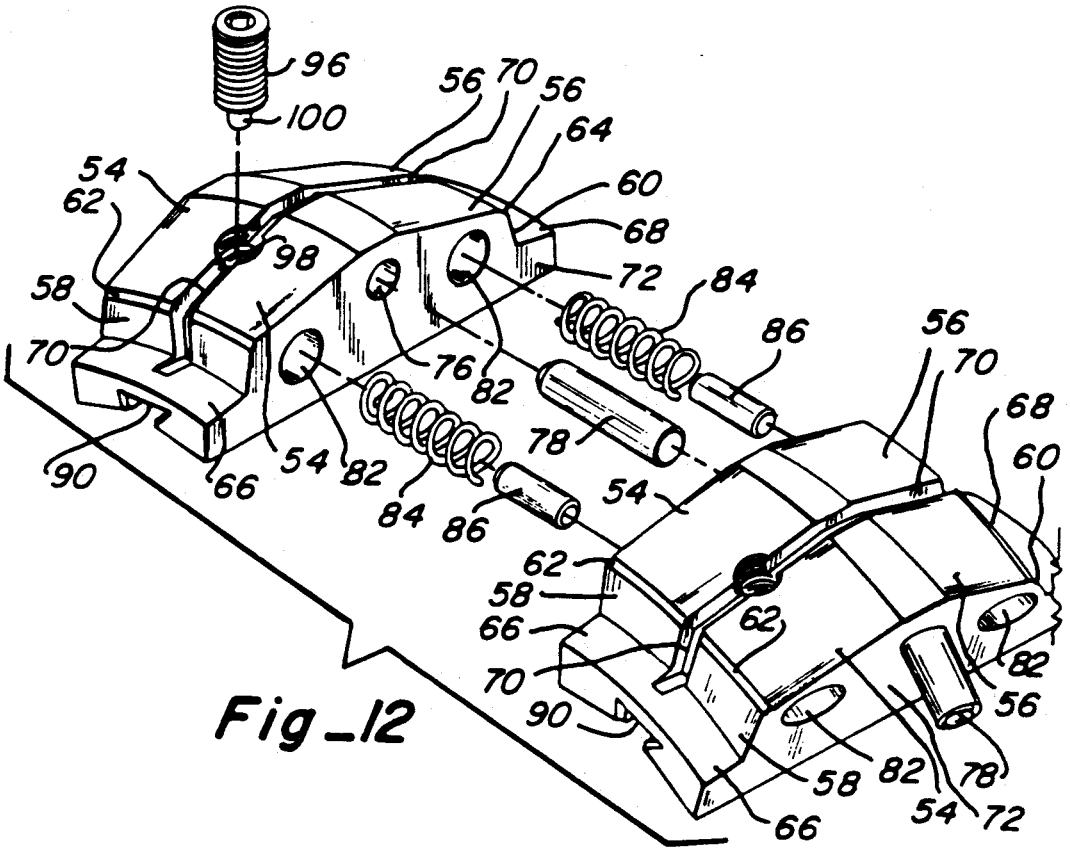
FIG. 12 is an exploded perspective view of two circumjacent die shoes of the present invention.

The top surfaces of housing 22 and ram pusher 44 also, respectively, define cutout portions 52 and 53 which enable the device to accommodate the free end of the bent portion of a long bent fitting. In addition, cutout portions 52 and 53 enable an operator to visually set and adjust depth stop 32, the procedure for which is described in detail below. Each die shoe 28, as best illustrated in FIG. 12, defines first or inner and second or outer convex, force reactive gradually inclined or shallow surfaces and 56, respectively, each of which is adjoined to first or inner and second or outer steep inclined convex, force reactive sur faces 58 and 60, respectively, by inner and outer inclined transition edges or surfaces 62 and 64, respectively. Each shoe also defines gradually inclined inner and outer ledges and 68, respectively, which adjoin steep inclined surfaces 53 and 60, respectively. Shallow surfaces 54 and 56 and ledges 66 and 68 are preferably inclined at an angle of about 12° from the crimping axis of device which is identified in FIG. 13 by the letter X. Steep inclined surfaces 58 and 60 are preferably inclined at an angle of about 82° from axis X with transaction edges 62 and 64 being inclined at an angle of about 47°. All of the aforementioned surfaces are also frustoconically shaped in that each defines a segment of a frustoconical surface which is formed when all of the dies are in contact and circumjacently arranged with respect to each other as illustrated, for example, in FIG. 14.

Each die shoe 28 also defines a groove 70 extending lengthwise from ledge 66 to ledge 68 across the center of the die shoe's inclined surfaces. The importance and operation of groove 70 will be described below.

Figure 13:
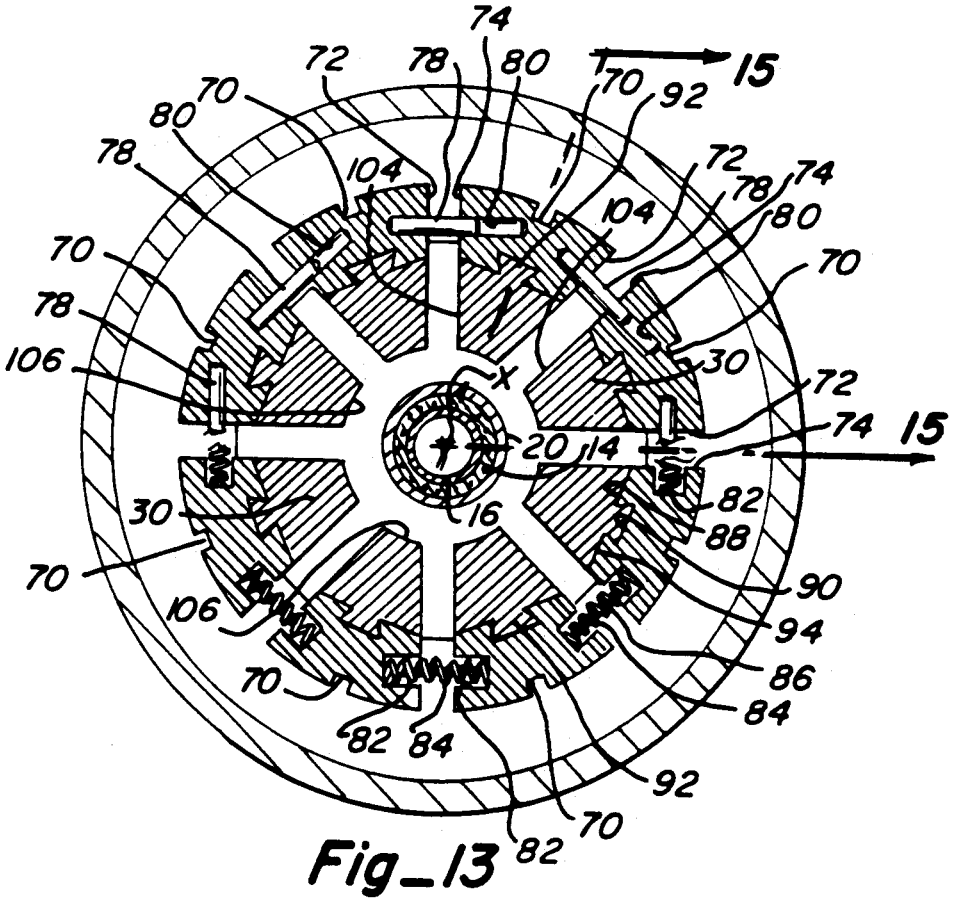
FIG. 13 is a cross-sectional view taken along the lines 13—13 of FIG. 9.
Figure 14:
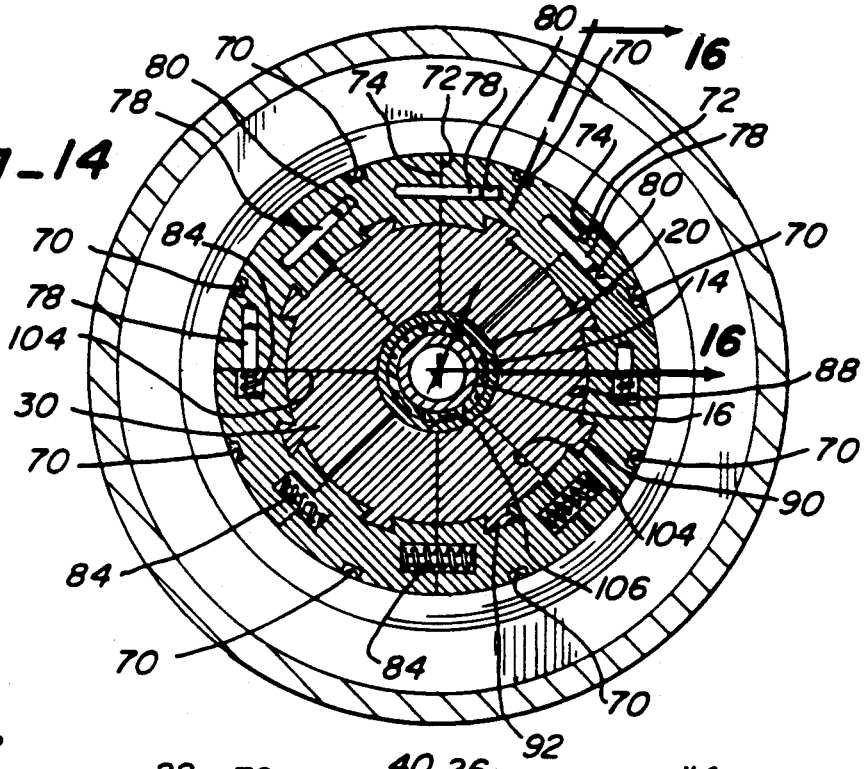
FIG. 14 is a cross-sectional view taken along the lines 14—14 of FIG. 10.

As best illustrated in FIGS. 13 and 14, each die shoe 28 also defines first and second sides 72 and 74, respectively, each of which is planar and angled so as to be aligned with a plane projecting radially from axis X.

In addition, each die shoe 28 defines a centrally located cylindrical bore 76 extending into the die shoe at a right angle as measured from side 72. Each bore 76 is sized to receive a complementary shaped, cylindrical pin 78 which is preferably rigidly attached to bore 76; for example, by threading or welding the pin to the bore. Each pin 78 projects outwardly at a right angle from side 72 and is provided with a length so that is also capable of extending into a cylindrical bore 80 provided in the circumjacent die it faces through the circumjacent die's side 74. Each bore 80 also extends inwardly into its respective die shoe at a right angle from its side 74. Moreover, each bore 80 must have a depth which enables it to slidably receive the full length of the portion of a pin 78 which projects outwardly from side 72 so that the die shoes can move radially inwardly to close as depicted in FIG. 14. Furthermore, to receive pin 78, each bore 80 must also be axially aligned with bore 76 of the circumjacent die shoe it faces.

While illustrated as being cylindrically shaped and centrally located on the sides of the die shoes, bore 76 and pins 78 may have any complementary shape and be located anywhere on-the sides of the shoes as long as the selected shape and location permits the desired radial die movement.

Each die shoe 28 also defines two pairs of cylindrical bores 82, one pair of which is located symmetrically on opposite sides of bore 76 of side 72, the other pair being symmetrically located about bore 80 of side 74. 8ores 82 extend into the die shoe at a right angle as measured from their respective sides and are sized to receive a coil spring 84 having a pin insert 86 located within the coil. As depicted in FIGS. 13 and 14, bores 82 of side 72 are axially aligned with those of side 74 of a circumjacent die shoe they face so that each facing or opposing pair of bores 82 can receive a coil spring 84 and pin insert 86.

Each die shoe further defines on an underside surface 88 thereof, a dove-tail shaped groove 90 which slidably receives a complementary shaped dove-tail projection 92 defined by a surface 94 of each die finger 30. Surfaces 38 and 94 are also complementary shaped as depicted in the Figures. The dove-tail grooves and projections slidably attach the die fingers to the die shoes.

Figure 15:
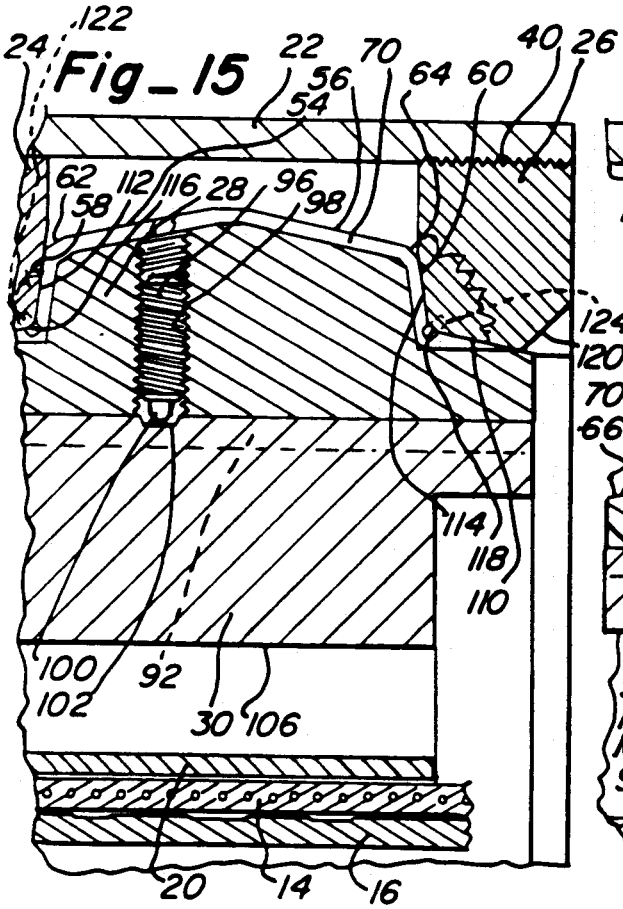
FIG. 15 is an enlarged partial cross-sectional view taken along lines 15—15 of FIG. 13.

Each die shoe 28 is also provided with a spring plunger means 96 which, as best depicted in FIG. 15, is threadably disposed in a threaded bore 98 of each die shoe. An end 100 of plunger 96 is spring loaded so as to impact up against and fit within a complementary shaped, selectively located detent 102 provided in surface 94 of each die finger 30. The insertation of end 100 in detent 102 prevents relative slidable movement between the die shoes and die fingers during the crimping stroke of device 10. However, the force exerted by plunger 96 can be easily overcome by an operator of device 10 who pushes the fingers in the direction of slidable attachment. Thus, an operator can easily remove die fingers 30 from the die shoes and insert other die fingers having a different crimping diameter, if such is desired.

Die fingers 30 also define sides 104 which are planar. Moreover, as with sides 72 and 74 of the die shoes, sides 104 are also angled so as to be aligned with a plane projecting radially from axis X. In addition, each die finger 30 defines a smooth and partially cylindrically shaped inner crimping surface 106. When crimping ferrule 20, surfaces 106 form a substantially cylindrical crimping surface about ferrule 20. While illustrated is being smooth, surfaces 106 could also be roughened (i.e, provided with indentations of some sort) to enhance crimping of the ferrule to the hose which may be desirable in some situations.

Inner and outer die rings 24 and 26 define force reactive, concave shallow or gradually inclined frustoconical surfaces 108 and 110, respectively, and force reactive concave steep inclined surfaces 112 and 114, respectively. The shallow and steep surfaces are adjoined by transition areas or surfaces 116 and 118, respectively. Surfaces 108 through 118 are sized and configured to complement inclined surfaces 54 through 64 of the die shoes so that the surfaces slide easily across each other. Accordingly, shallow surfaces 108 and 110 are also preferably inclined at an angle of 12° from axis X, steep inclined surfaces 112 and 114 at an angle of 82" and transition edges 116 and 118 at an angle of 47° from axis X. Each die ring, particularly outer die ring 26, is also preferably provided with a beveled edge 120 on the side of the ring opposite that defining the rings' steep inclined surfaces. The beveled edges, as illustrated, are inclined at an angle of about 45° from axis X and, as such, serve to facilitate insertion of a bent fitting between the die fingers.

Inner and outer rings 24 and 26 are also coaxial or axially aligned about axis X and oriented with respect to each other so that their respective steep inclined surface 112 and 114 face each other.

While the values set forth above for the various angles are preferred, the angles may be varied somewhat as may be necessary for a specific application. Generally, however, the steep surfaces will be angled between about 70° and 86° from ring axis X and the shallow surfaces between about 6° to 20° from ring axis X. Steep surfaces having an angle greater than about 86° will generally be too close to a right angle to initiate radial movement of the die shoes. Steep surfaces angled less than 70° and shallow surfaces less than 6° are also undesirable in that they will generally require a longer cylinder stroke. Shallow surfaces greater than 20° are also undesirable in that they will require the application of more crimping force from the hydraulic activating means.

FIGS. 9, 13 and 15 illustrate device 10 in its open loading position wherein springs 84 hold die shoes 28 and fingers 30 in their fully retracted position away from axis X. This position permits the insertion of a fitting such as bent fitting 16 between the die fingers. When in the open position, die shoes 28 are supported by inner and outer shallow surfaces 108 and 110 of the inner and outer rings, respectively, which supportingly contact the die shoes' inner and outer ledges 66 and 68, respectively. The die shoes' steep surfaces 58 and 60 will also generally be in contact with steep surfaces 112 and 114 of the inner and outer rings when the die shoes are in the open position.

Figure 16:
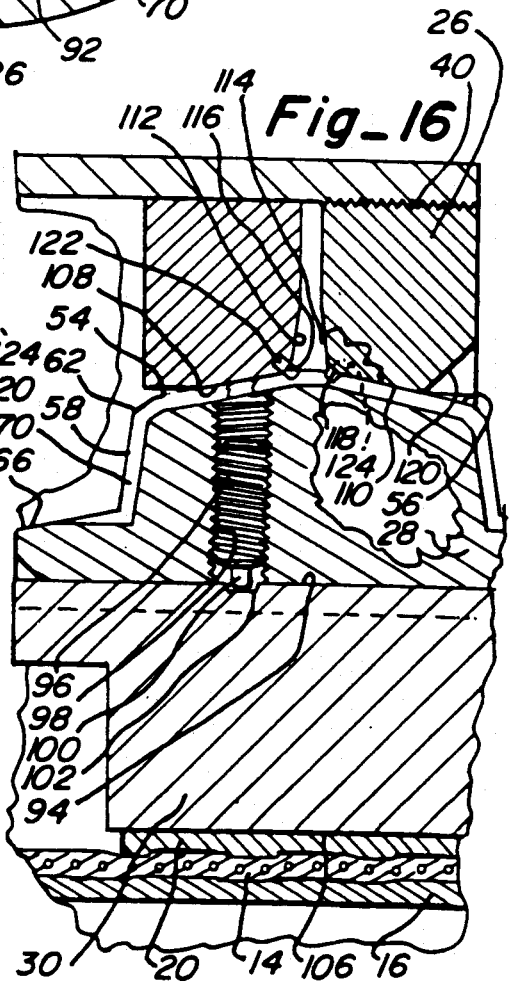
FIG. 16 is an enlarged, partial, cross-sectional view taken along lines 16—16 of FIG. 14.

FIGS. 10, 14 and 16 illustrate crimping device 10 in the crimping position wherein die shoes 28 and die fingers 30 have moved radially inward to crimp ferrule 20. In moving to this position from the open position illustrated in FIG. 9, it will be appreciated that movable inner die ring 24 attached to ram pusher 44 has been moved axially forward along axis X by the axial forward stroke of piston 50. This axial movement of die ring 24 towards outer die ring 26, in effect, pushes the die fingers and shoes radially inward. In so doing, the die shoes' ledges 66 and 68 at first lift off or separate from the die rings' respective shallow surfaces 108 and 110. The die shoes' steep sur faces 58 and 60 then slide, respectively, across the complementary shaped, steep surfaces 112 and 114 of the inner and outer die rings, respectively. This sliding engagement continues until transition edges 62 and 64 of the die shoes contact transition edges 116 and 118 of the inner and outer rings, respectively. The transition edges then slide, respectively, across each other until the respective shallow surfaces 54 and 56 of the die shoes contact the shallow surfaces 108 and 110 of the die rings, respectively. Further movement of inner die ring 24 towards outer die ring 26 causes the shallow surfaces of the die shoes and rings to slide across each other, thereby pushing the die shoes and fingers radially inward to crimp the ferrule.

To return die shoes 28 and die fingers 30 to the open position to enable removal of hose assembly 12 after ferrule 20 has been crimped, piston 50 is activated to initiate the device's return stroke which moves inner ring 24 axially away from outer ring 26. This action allows springs 84 located between each circumjacent die shoe to recoil, thereby separating the die shoes and causing the die shoes' and rings' respective inclined surfaces to slide back across each other until the die shoes and fingers are back in the open position. Pin inserts 86 which are located within the coil springs are of help in keeping the coil springs properly aligned and maintained within bores 82 of the dies shoes, thereby preventing damage to the springs during crimping and during assembly of the machine. They are also believed to be of help in maintaining the die shoes in alignment during crimping.

An important aspect of the present invention is directed to maintaining die shoes 28, and thus, die fingers 30, in alignment during crimping as the shoes and fingers move radially between the open and crimping positions. Maintaining such alignment is particularly difficult when the respective transition surfaces of the die shoes and die rings are sliding across each other. If, for example, the inner transition surfaces of a die shoe and die ring slide across each other slightly ahead of the outer transition surfaces, the outer transition surfaces may slip off of outer die ring 26 (i.e., outwardly away from axis X) which, in turn, will cause the inner transition surfaces to slip off inner die ring 24 (i.e., inwardly towards axis X), thereby tipping the die shoe. Such tipping is undesirable because it often causes other dies to tip; thereby jamming the entire device.

Figure 1:
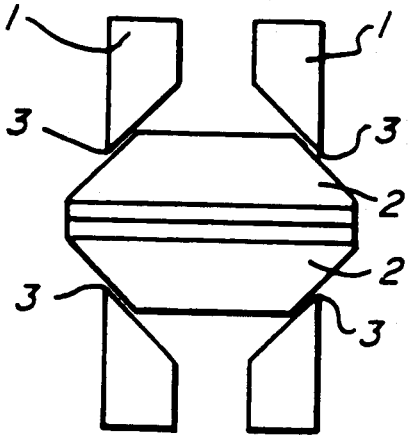
Fig 1 PRIOR ART
FIG. 1 is a cross-sectional view of the crimping head of a prior art single angle, double ring crimping apparatus which illustrates the crimping head in its closed or crimping position.
Figure 2:
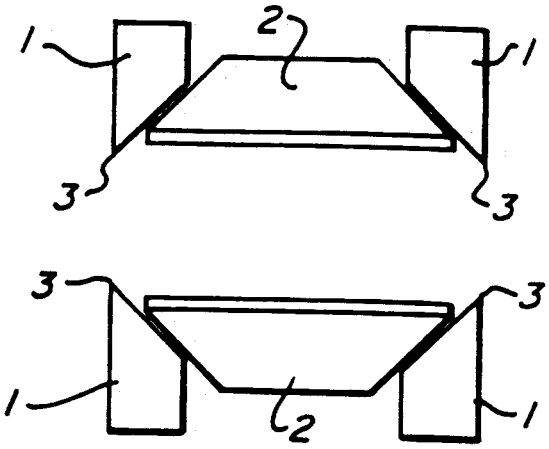
Fig 2 PRIOR ART
FIG. 2 is a cross-sectional view of the prior art crimping apparatus illustrated in FIG. 1 showing the crimping head in its open position.
Figure 3:
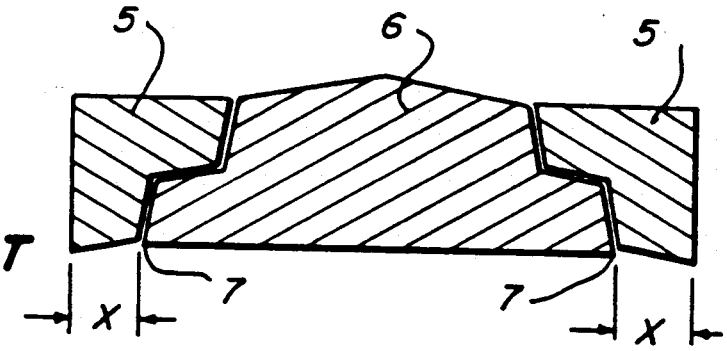
Fig 3 PRIOR ART
FIG. 3 is a partial, cross-sectional view of the crimping head of a double cone, double angle crimping apparatus illustrating a die and the rings of the crimping head in the open position.
Figure 4:
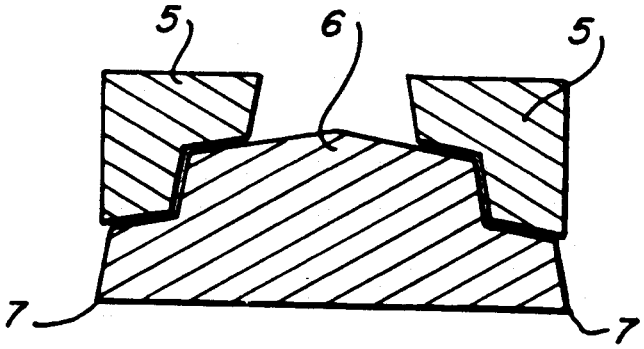
Fig 4 PRIOR ART
FIG. 4 is a partial, cross-sectional view illustrating the crimping head components of FIG. 3 in the closed die or crimping position.
Figure 5:
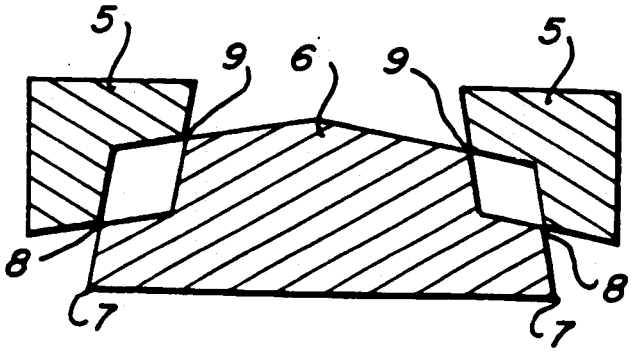
Fig 5 PRIOR ART
FIG. 5 is a partial, cross-sectional view of the components illustrated in FIGS. 3 and 4 showing the components at a position intermediate the open and crimping positions.

The die shoes of conventional double step, double ring crimping devices such as that illustrated in FIGS. 3 through 5 are prevented from tipping because, as illustrated in FIG. 5, each die shoe, (i.e., die shoes 7 of FIG. 5) slides through two transition areas (identified in FIG. 5 by numerals 8 and 9) which are provided on each die ring. The use of two transition areas prevents tipping because the transition areas apparently act as braces to support each other as they slide across each other. While this is advantageous, the large width of a double step die ring is, as previously mentioned, objectional because it increases the distance a fitting has to be inserted between the dies, thereby lengthening the crimping head which makes it much more difficult to insert bent fittings.

Pins 78 solved the aforementioned tipping problem confronting die shoes 28 because they apparently prevent the die shoes from rotating relative to each other; that is, as long as each pin 78 remains at least partially disposed within its associated bore 80 of the circumjacent die shoe it faces.

To further enhance alignment of the die shoes and fingers, device 10 is also preferably provided with means for preventing rotational movement of the die shoes as a unit with respect to the die rings. The means for preventing such in device 10 includes a pair of inner and outer tines 122 and 124 for each die shoe, which, respectively, project outwardly from transition edges 116 and 118 of inner and outer rings 24 and 26. Tines 122 and 124 are sized and configured to slide within grooves 70 of the die shoes as the shoes move radially between the open and crimping die positions. This slidable engagement of the tines and grooves is best illustrated in FIGS. 15 and 16 wherein it can be visualized that a pair of tines 122 and 124 slides within a groove 70 of a die shoe as the rings move the die shoes.

While eight pairs of inner and outer tines are illustrated in the figures, fewer pairs (i.e., possibly four pairs) may also prevent rotational movement of the die shoes as a unit with respect to the die rings. Moreover, while device 10 employs tines and grooves to prevent such rotational movement, other means for preventing such movement are considered to be within the scope of the present invention. For example, instead of a groove 70, each die shoe 28 could be provided with a longitudinally extending ridge which would slidably engage with a pair of grooves extending across the transition edges of the inner and outer die rings.

Inasmuch as the aforementioned pins 78 and tines and grooves 122 and 124, respectively, maintain die shoes 28 in alignment and prevent their tipping during crimping (i.e., during radial movement of the dies shoes) it will be appreciated that the need for die rings having two transition areas for supporting the dies shoes during crimping is obviated. Accordingly, relatively thin die rings such as die rings 24 and 26 having only one transition area (defined by a single pair of steep and shallow concave frustoconical surfaces) can be employed. This is advantageous, as previously alluded to, because it shortens the crimping head thereby making it easier to insert bent fittings through the opening defined by the open die fingers Device 10 has an extremely short crimping head as characterized by its axial crimping head length to radial die movement ratio which is only 8:1. This is significantly less than the 12.8:1 ratio, previously described above in the background section for the Saudr Type 88 press. Device 10 can also accommodate hose having an inside diameter of two inches whereas, the Saudr type 88 crimper can only accommodate 1½ inch ID hose.

Preferred axial crimping head length to radial die movement ratios in accordance with the present invention, will be less than 12.8:1 with ratios between about 6:1 and 9:1 providing extremely good results. The 8:1 ratio of device 10 was determined by dividing the axial length of the crimping head in it open position by the radial distance travelled by a die finger 30 during a crimping stroke of device 10. The axial length of the crimping head of device 10 in its open position is 6 inches which is the axial distance between the outer facing surface 25 of outer ring 26 and inner facing surface 125 of ram pusher 44. The radial distance travelled by a die finger of device 10 during a crimping stroke is 0.75 inches.

It will be appreciated from FIGS. 9 and 10 that the die shoes and fingers not only move radially as they move between the open and crimping positions but also axially a distance equal to ½ Y. They move only one half the axial distance moved by inner ring 21 and are half ring 24's axial speed because they are constrained to remain centered between the inner and outer rings as such movement takes place. Since the depth stop moves at the same axial speed as inner ring 24, it also moves at twice the die shoes' and fingers' axial speed, thereby making it difficult to set the depth stop so that the die fingers crimp only the ferrule, which problem is discussed above in the background section of the invention.

The present invention solves the problem of setting or positioning the ferrule by providing means for reducing the axial speed of depth stop 32 so that it travels axially forward at the same rate that the die shoes and fingers travel axially forward. Accordingly, ferrule 20 can be precisely crimped, as desired, by simply maintaining bent fitting 16 up against the depth stop during the crimping stroke of device 10. One only needs to properly adjust the depth or axial position of the depth stop which is quite simple with device 10, as will be explained below.

Depth stop 32, as best illustrated in FIGS. 9–11, is generally disk shaped and attached at its center to a proximal end 126 of a cylindrical rod or stem 128. A distal end 130 of item 128 is slidably received and in telescoping engagement with a cylindrical centering tube 132 Centering tube 132 is slidingly received by an axially aligned cylindrical bore 134 defined by back plate centering means 46. A distal end 136 of centering tube 132 is also slidably received in a cylindrical, axially aligned bore 138 defined by a stationary depth stop spacer 140. Depth stop spacer 140 is positioned against and supported by a disc-shaped back plate 142 of device 10 which, in turn, is threadably secured to an end 144 of cylindrical housing 22.

The other end of centering tube 132 identified by numeral 146 in FIG. 11 is provided with an integral threaded extension 148 which threadably engages with a depth stop adjusting handle 150 having an end 152. Tightening handle 150 will cause end 152 to impact against stem 128 thereby tightly securing stem 128 and centering tube 132 together. Accordingly, it will be appreciated that by untightening handle 150, stem 128 can be telescopingly moved within tube 132, thereby enabling one to adjust the depth or axial position of depth stop 32.

Returning to FIGS. 9 and 10, it can be seen that a cylindrical collar 154 is mounted on and attached by a set screw 156 to centering tube 132 at a point along the centering tube's midsection. It can also be seen that front and back springs 34 and 36 are mounted on or located over centering tube 132 on opposite sides of collar 154 so that a first end 158 of front spring 34 is located against centering plate 46 of the ram pusher and a second end 160 of spring 34 located against collar 154. The other side of collar 154 has a first end 162 of back spring 36 located against it and a second end 164 of back spring 36 located against an end surface 166 of depth stop spacer 140.

As previously mentioned, FIG. 9 illustrates device 10 in the open position and FIG. 10 illustrates the crimping position. Accordingly, when comparing coil springs 34 and 36 in FIGS. 9 and 10, it will be recognized that in moving from the open position to the crimping position coil springs 34 and 36 have recoiled a certain extent. By so recoiling, the coil springs reduce the forward axial speed of the depth stop relative to the forward axial stroke of piston 50 which moves die ring 24. If springs 34 and 36 are of equal strength and collar 154 is located on centering tube 132 such that both springs exert an equal force on it (which generally means that collar 154 will be located equidistant between the springs) the forward axial speed of depth stop 32 will be exactly ½ that of inner die ring 24. Accordingly, the depth stop will move axially forward with the die shoes and die fingers and at the same rate. Thus, the depth stop and die fingers relative positions will remain unchanged as device 10 makes its crimping stroke.

Thus, to precisely crimp a ferrule, as desired, with the depth stop speed reducing means of the present invention, one only has to do the following:

1. insert hose assembly 12 between the die fingers;

2. position the hose assembly between the die fingers so that the ferrule will be crimped at the desired position. Generally, this only requires that the end of the ferrule be aligned or flush with an inner end of a die finger;

3. position the depth stop up against the fitting of the hose assembly;

4. tighten the depth stop handle 150 so that the depth stop maintains its position relative to the die fingers as the die fingers are moved from the open to the crimping position; and 5. maintain or hold-the fitting up against the depth stop until the die fingers begin crimping the ferrule.

This invention has been described in detail with reference to particular embodiments thereof, but it will be understood that various other modifications can be effected within the spirit and scope of this invention.

I claim:

1. In a crimping apparatus for use with straight and bent tube fittings and of the type with first and second crimping rings that are arranged coaxial with and axially spaced apart from each other along a ring axis, the rings having facing frustoconical surfaces that engage oppositely facing frustoconical surfaces of a plurality of crimping members interpositioned between the rings and arranged substantially circumjacently around and radially spaced form the ring axis and defining an opening along the ring axis, and where one ring is stationary and the other ring is reciprocally moveable along the ring axis and the crimping members are moveable in the direction of the ring axis and in relation to the moveable ring, means for holding and positioning the rings, means for holding and positioning the rings, a means for reciprocating the moveable ring along the ring axis, and an activating means, and wherein the improvement comprises:

a generally tubularly shaped housing having a substantially cylindrically shaped chamber and a radial cut out sized to receive bent tube fittings, the moveable ring disposed in and reciprocally moveable within the cylindrical chamber in an end portion of the housing that includes the holding and positioning means; a cylindrically shaped ram pusher disposed in and reciprocally moveable in the cylindrically shaped chamber, the ram pusher having an internal chamber a radial cut out aligned with the housing cut out and sized to receive bent tube fittings, and wherein the opening defined by the crimping members, the internal chamber of the ram pusher, and the radial cut outs are in communication with each other and sized to receive bent tube fittings, and wherein the ram pusher has an end portion juxtaposed the moveable ring and defines the means for reciprocating the moveable ring.

2. The crimping apparatus as claimed in claim 1 wherein the cutouts of the housing and ram pusher are slots oriented in the direction of the ring axis.

3. The crimping apparatus as claimed in claim 1 wherein the ram pusher includes a disc shaped back plate interconnected to the activating means.

* * * * *